US009795822B2

(12) United States Patent
Smith et al.

(10) Patent No.: US 9,795,822 B2
(45) Date of Patent: Oct. 24, 2017

(54) WEIGHT SELECTOR FOR MULTIPLE DUMBBELLS

(71) Applicant: ICON Health & Fitness, Inc., Logan, UT (US)

(72) Inventors: Kent M. Smith, Nibley, UT (US); William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/867,935

(22) Filed: Sep. 28, 2015

(65) Prior Publication Data

US 2016/0089560 A1 Mar. 31, 2016

Related U.S. Application Data

(60) Provisional application No. 62/057,904, filed on Sep. 30, 2014.

(51) Int. Cl.
*A63B 21/005* (2006.01)
*A63B 21/02* (2006.01)
(Continued)

(52) U.S. Cl.
CPC ..... *A63B 21/075* (2013.01); *A63B 21/0726* (2013.01); *A63B 24/0062* (2013.01);
(Continued)

(58) Field of Classification Search
CPC ..... A63B 21/0004; A63B 21/00058; A63B 21/00061; A63B 21/00065;
(Continued)

(56) References Cited

U.S. PATENT DOCUMENTS 5,637,064 A * 6/1997 Olson ..... A63B 21/0728 482/107
5,769,762 A * 6/1998 Towley, III ..... A63B 21/0605 482/107
(Continued)

FOREIGN PATENT DOCUMENTS

CN 1990068 11/2009
CN 201346371 11/2009
(Continued)

OTHER PUBLICATIONS

English Translation of Chinese Search Report issued for 201510633347.4 dated Jun. 27, 2017.
(Continued)

*Primary Examiner* — Loan H Thanh
*Assistant Examiner* — Gary D Urbiel Goldner
(74) *Attorney, Agent, or Firm* — Holland & Hart LLP

(57) ABSTRACT

A dumbbell assembly includes a cradle shaped to receive a first dumbbell having a first weight set and a second dumbbell having a second weight set. The dumbbell assembly further includes an input mechanism in communication with a selection mechanism incorporated into the cradle where the selection mechanism is in communication with both a first selector arranged to adjust a first connection of the first weight set to the first dumbbell and a second selector arranged to adjust a second connection of the second weight set to the second dumbbell.

12 Claims, 14 Drawing Sheets

(51) Int. Cl.

| | |
|---|---|
| ***A63B 21/072*** | (2006.01) |
| ***A63B 21/075*** | (2006.01) |
| ***A63B 24/00*** | (2006.01) |
| *A63B 71/00* | (2006.01) |
| *A63B 71/06* | (2006.01) |

(52) U.S. Cl.

CPC ..... *A63B 24/0087* (2013.01); *A63B 21/0058* (2013.01); *A63B 21/023* (2013.01); *A63B 71/0036* (2013.01); *A63B 2024/0068* (2013.01); *A63B 2024/0093* (2013.01); *A63B 2071/068* (2013.01); *A63B 2071/0683* (2013.01); *A63B 2220/17* (2013.01); *A63B 2225/20* (2013.01); *A63B 2225/50* (2013.01); *A63B 2230/75* (2013.01)

(58) Field of Classification Search

CPC ..... A63B 21/00069; A63B 21/062; A63B 21/0622; A63B 21/0624; A63B 21/0626; A63B 21/0628; A63B 21/063; A63B 21/0632; A63B 21/072; A63B 21/0722; A63B 21/0724; A63B 21/0726; A63B 21/0728; A63B 21/075; A63B 21/15; A63B 21/154; A63B 21/155; A63B 21/156; A63B 21/157; A63B 21/22; A63B 21/4023; A63B 21/4033; A63B 21/4035; A63B 21/4043; A63B 21/4047; A63B 21/4049; A63B 71/0036; A63B 2071/0694; A63B 2225/09

See application file for complete search history.

(56) References Cited

U.S. PATENT DOCUMENTS

| | | | | |
|---|---|---|---|---|
| 6,039,678 | A * | 3/2000 | Dawson | A63B 21/0728 482/104 |
| 6,099,442 | A * | 8/2000 | Krull | A63B 21/0728 482/107 |
| 6,228,003 | B1 * | 5/2001 | Hald | A63B 21/0728 482/107 |
| 6,261,022 | B1 | 7/2001 | Dalebout et al. | |
| 6,322,481 | B1 * | 11/2001 | Krull | A63B 21/0728 482/106 |
| 6,416,446 | B1 * | 7/2002 | Krull | A63B 21/0628 482/107 |
| 6,422,979 | B1 * | 7/2002 | Krull | A63B 21/0728 482/107 |
| 6,500,101 | B1 | 12/2002 | Chen | |
| 6,899,661 | B1 * | 5/2005 | Krull | A63B 21/0628 482/107 |
| 6,997,856 | B1 * | 2/2006 | Krull | A63B 21/075 482/104 |
| 7,060,011 | B1 * | 6/2006 | Krull | A63B 21/0728 482/107 |
| 7,077,791 | B2 | 7/2006 | Krull | |
| 7,137,932 | B2 | 11/2006 | Doudiet | |
| 7,156,782 | B1 * | 1/2007 | Krull | A63B 21/4029 482/104 |
| 7,172,536 | B2 | 2/2007 | Liu | |
| 7,223,214 | B2 | 5/2007 | Chen | |
| 7,291,098 | B1 * | 11/2007 | Krull | A63B 71/0036 482/107 |
| 7,413,533 | B2 | 8/2008 | Lin | |
| 7,578,771 | B1 * | 8/2009 | Towley, III | A63B 1/04 482/104 |
| 7,614,983 | B1 * | 11/2009 | Krull | A63B 21/0728 482/107 |
| 7,621,855 | B1 * | 11/2009 | Krull | A63B 21/0728 482/107 |
| 8,002,680 | B2 | 8/2011 | Crawford et al. | |
| 8,025,613 | B1 | 9/2011 | Wang | |
| 8,298,125 | B2 | 10/2012 | Colledge et al. | |
| 9,022,907 | B2 * | 5/2015 | Wang | A63B 21/075 482/108 |
| 2002/0002106 | A1 * | 1/2002 | Krull | A63B 21/0728 482/107 |
| 2002/0055426 | A1 * | 5/2002 | Krull | A63B 21/0728 482/98 |
| 2002/0115539 | A1 * | 8/2002 | Krull | A63B 21/0728 482/106 |
| 2004/0005968 | A1 | 1/2004 | Crawford et al. | |
| 2004/0023765 | A1 * | 2/2004 | Krull | A63B 71/0036 482/142 |
| 2004/0198569 | A1 * | 10/2004 | Sanford-Schwentke | A63B 21/0726 482/108 |
| 2005/0079961 | A1 * | 4/2005 | Dalebout | A63B 21/075 482/106 |
| 2005/0277525 | A1 * | 12/2005 | Liu | A63B 21/075 482/107 |
| 2006/0025287 | A1 | 2/2006 | Chermack | |
| 2006/0189458 | A1 * | 8/2006 | Walkerdine | A63B 21/0728 482/106 |
| 2006/0240958 | A1 * | 10/2006 | Liu | A63B 21/075 482/107 |
| 2007/0087918 | A1 * | 4/2007 | Towley, III | A63B 21/075 482/107 |
| 2007/0167300 | A1 | 7/2007 | Krull | |
| 2007/0254785 | A1 * | 11/2007 | Lin | A63B 21/0728 482/108 |
| 2008/0032874 | A1 * | 2/2008 | Towley | A63B 21/0726 482/106 |
| 2009/0048079 | A1 | 2/2009 | Nalley | |
| 2009/0124470 | A1 | 5/2009 | Yu | |
| 2009/0186748 | A1 * | 7/2009 | Golesh | A63B 21/0728 482/107 |
| 2010/0179032 | A1 * | 7/2010 | Perry | A63B 71/0036 482/94 |
| 2010/0304938 | A1 * | 12/2010 | Olson | A63B 21/075 482/107 |
| 2011/0312475 | A1 * | 12/2011 | Towley, III | A63B 21/075 482/107 |
| 2012/0115689 | A1 | 5/2012 | Dalebout et al. | |
| 2012/0264575 | A1 * | 10/2012 | Towley, III | A63B 21/00065 482/107 |
| 2012/0289386 | A1 * | 11/2012 | Yu | A63B 21/075 482/107 |
| 2014/0005811 | A1 | 1/2014 | Mikan et al. | |
| 2014/0274596 | A1 * | 9/2014 | Krull | A63B 21/0724 482/107 |
| 2014/0349820 | A1 * | 11/2014 | Wang | A63B 21/075 482/108 |
| 2015/0297936 | A1 * | 10/2015 | Madden | A63B 21/0726 482/107 |
| 2015/0360073 | A1 * | 12/2015 | Moran | A63B 21/075 482/107 |
| 2015/0367163 | A1 * | 12/2015 | Moran | A63B 21/075 482/108 |

FOREIGN PATENT DOCUMENTS

| | | |
|---|---|---|
| CN | 201799053 U | 4/2011 |
| CN | 106659921 | 5/2017 |
| TW | M379445 | 5/2010 |
| TW | I477303 | 3/2015 |
| WO | 9417862 | 8/1995 |
| WO | 2012058612 | 5/2012 |
| WO | 201603373 | 3/2016 |

OTHER PUBLICATIONS

English Abstract translated via patsnap.com of CN201346371. Nov. 18, 2009.

English Translation of Taiwan First Office Action and Search Report issued for 104131457 dated Mar. 15, 2017.

English Translation via Orbit.com of the Abstract of TWM 379445. May 1, 2010.

(56) References Cited

OTHER PUBLICATIONS

English Translation via Orbit.com of the Abstract of CN 201799053U. Apr. 20, 2011.
English Translation via Orbit.com of the Abstract of TWI477303. Mar. 21, 2015.

* cited by examiner

WEIGHT SELECTOR FOR MULTIPLE DUMBBELLS

RELATED APPLICATIONS

This application claims priority to U.S. Patent Application Ser. No. 62/057,904 titled "Weight Selector for Multiple Dumbbells" and filed on 30 Sep. 2014, which application is herein incorporated by reference for all that it discloses.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. One type of exercise device that provides resistance to user's muscle contraction is a dumbbell. A dumbbell often includes a handle and weights at either end of the handle. In some cases, the weights are permanently affixed to the handle. Other types of dumbbells are adjustable where the weights can be removed and/or added to allow the user to adjust the amount of weight on the dumbbell.

One type of dumbbell is disclosed in U.S. Pat. No. 7,172,536 issued to Wei Ming Liu. In this reference, an adjustable dumbbell includes a number of weights each having a slot to receive end portions of a bar, and a number of latch rods slidably engaged in the weights and each having an inner end engageable into the slots of the weights and engageable with the bar, to anchor and latch a selected number of the weights to the bar, and to allow the selected weights to be moved in concert with the bar. The weights each have a spring member to bias and force the inner end of the latch rod to engage with and to latch the weights to the bar. The weights each include a panel having an orifice to slidably receive the latch rod, and to anchor the latch rod to the panel when the catch of the knob is rotated relative to the panel. Other types of dumbbells are described in U.S. Pat. No. 6,500,101 issued to James Chen, U.S. Patent Publication No. 2004/0005968 issued to Douglas A. Crawford, et al., U.S. Patent Publication No. 2012/0115689 issued to William Dalebout, et al., and WIPO International Publication No. WO/1994/017862 issued to Carl K. Towley. Each of these documents are herein incorporated by reference in their entirety for all that they contain.

SUMMARY

In one aspect of the invention, a dumbbell assembly includes a cradle shaped to receive a first dumbbell having a first weight set and a second dumbbell having a second weight set.

In one aspect of the invention, the dumbbell assembly includes an input mechanism in communication with a selection mechanism incorporated into the cradle.

In one aspect of the invention, the selection mechanism is in communication with both a first selector arranged to adjust a first connection of the first weight set to the first dumbbell and a second selector arranged to adjust a second connection of the second weight set to the second dumbbell.

In one aspect of the invention, the input mechanism is incorporated into the cradle.

In one aspect of the invention, the first selector is integrated into the first dumbbell and the second selector is integrated into the second dumbbell.

In one aspect of the invention, the input mechanism includes a rotary dial.

In one aspect of the invention, the selection mechanism includes a rotary gear positioned to rotate the first selector and the second selector simultaneously as the rotary dial is rotated.

In one aspect of the invention, the dumbbell assembly further includes a motor in communication with the input mechanism and operable to actuate the selection mechanism.

In one aspect of the invention, the first selector is aligned with a first support structure of the first dumbbell and the second selector is aligned with a second support structure of the second dumbbell.

In one aspect of the invention, the first selector includes a first cam mechanism arranged to adjust the first connection of the first weight set to the first dumbbell and the second selector includes a second cam mechanism arranged to adjust a second connection of the second weight set to the second dumbbell.

In one aspect of the invention, the first selector includes a first rod configured to disconnect a first weight of the first weight set from the first dumbbell and the second selector includes a second rod configured to disconnect a second weight of the second weight set from the second dumbbell.

In one aspect of the invention, the first selector and the second selector are rotary selectors.

In one aspect of the invention, the first selector is in communication with a first interlocking pin positioned to interlock a first subset of the first weight set with the first dumbbell based on a first rotary orientation of the first selector and the second selector is in communication with a second interlocking pin positioned to interlock a second subset of the second weight set with the second dumbbell based on a second rotary orientation of the second selector.

In one aspect of the invention, the first selector includes a groove shaped to allow the first interlocking pin to retract and thereby release the first subset of the first weight set from the first dumbbell based on a second rotary orientation of the first selector.

In one aspect of the invention, a cradle includes a first trough shaped to receive a first dumbbell having a first weight set and a second trough shaped to receive a second dumbbell having a second weight set.

In one aspect of the invention, the cradle includes an input mechanism in communication with a linkage incorporated into the cradle.

In one aspect of the invention, the linkage is in communication with both a first selector arranged to adjust a first connection of the first weight set to the first dumbbell and a second selector arranged to adjust a second connection of the second weight set to the second dumbbell when the first dumbbell and the second dumbbell are docked in the cradle.

In one aspect of the invention, the first selector includes a first rod configured to disconnect a first weight of the first weight set from the first dumbbell and the second selector includes a second rod configured to disconnect a second weight of the second weight set from the second dumbbell.

In one aspect of the invention, the input mechanism is a rotary dial.

In one aspect of the invention, the linkage is a rotary gear positioned to rotate the first selector and the second selector as the rotary dial is rotated.

In one aspect of the invention, the cradle further includes a motor in communication with the input mechanism and operable to actuate the linkage.

In one aspect of the invention, a dumbbell assembly includes a cradle shaped to receive a first dumbbell having a first weight set and a second dumbbell having a second weight set.

In one aspect of the invention, the dumbbell assembly further includes a rotary dial incorporated in the cradle in communication with a rotary gear incorporated in the cradle.

In one aspect of the invention, the rotary gear is in communication with both a first rotary selector arranged to adjust a first connection of the first weight set to the first dumbbell and a second rotary selector arranged to adjust a second connection of the second weight set to the second dumbbell.

In one aspect of the invention, the first rotary selector is in communication with a first interlocking pin positioned to interlock a first subset of the first weight set with the first dumbbell based on a first rotary orientation of the first rotary selector and the second rotary selector is in communication with a second interlocking pin positioned to interlock a second subset of the second weight set with the second dumbbell based on a second rotary orientation of the second selector.

In one aspect of the invention, the first rotary selector includes a groove shaped to allow the first interlocking pin to retract and thereby release the first subset of the first weight set from the first dumbbell based on another rotary orientation of the first rotary selector.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Often users desire to change the amount of weight that is secured to a dumbbell as they switch between different types of exercises. Changing the amount of weight by hand can be time consuming, especially when multiple types of exercises involving different weight amounts are incorporated into a single workout session. Additionally, the delay associated with changing the amount of weight by hand can result in an undesirable drop in heart rate during a workout.

The principles described in the present disclosure include a dumbbell assembly having a cradle shaped to receive a first dumbbell having a first weight set and a second dumbbell having a second weight set. An input mechanism is in communication with a selection mechanism incorporated into the cradle where the selection mechanism is in communication with both a first selector arranged to adjust a first connection of the first weight set to the first dumbbell and a second selector arranged to adjust a second connection of the second weight set to the second dumbbell.

For purposes of this disclosure, the term "aligned" means parallel, substantially parallel, or forming an angle of less than 35 degrees. For purposes of this disclosure, the term "transverse" means perpendicular, substantially perpendicular, or forming an angle between 55 and 125 degrees.

Figure 1:
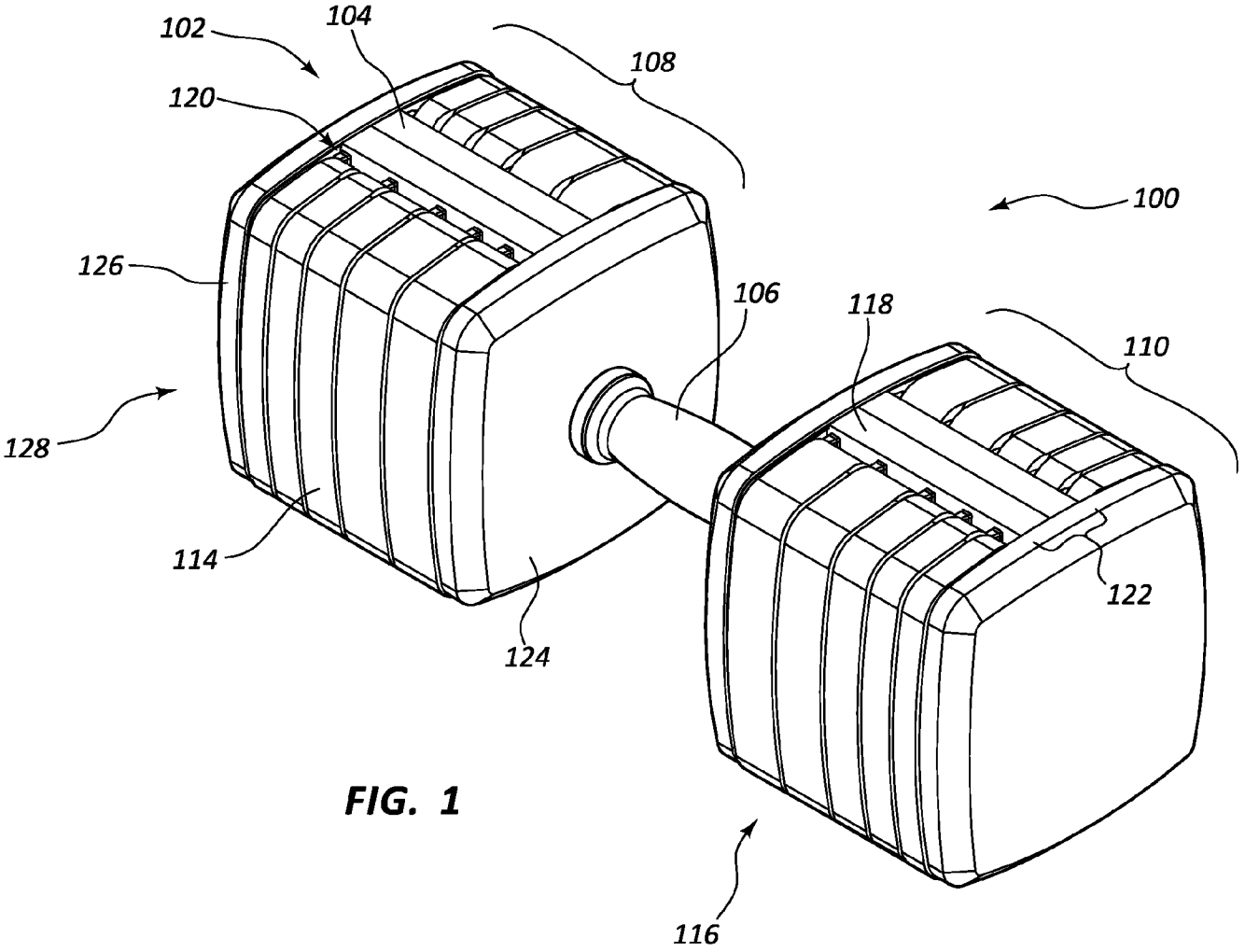
FIG. 1 illustrates a top perspective view of an example of a dumbbell in accordance with the present disclosure.

Particularly, with reference to the figures, FIG. 1 depicts a first dumbbell 100 that includes a support structure 102. The support structure 102 includes a carriage 104 and a handle 106.

The handle 106 is disposed between a first section 108 and a second section 110 of the carriage 104. The handle 106 is shaped to allow a user to grasp the handle 106 with his or her hand. While the handle 106 is depicted with a substantially circular cross section in the illustrated example, the handle 106 may include any appropriate type of shape. Further, the handle 106 may include a texture or other gripping surface that increases the friction between a user's hand and outside surface of the handle 106. In some examples, the handle 106 includes a solid cross section, while in other examples, the handle 106 forms a cavity in which weight selectors or other mechanism of the first dumbbell 100 can reside. The handle 106 is also made, at least in part, of a material that has a sufficient strength to move the first and second sections 108, 110 of the carriage 104 loaded with weights 114 with the first dumbbell 100 as the user moves the first dumbbell 100 by moving the handle 106.

The carriage 104 may include one or more mechanisms for forming one or more connections between a weight 114 of a first weight set 116. The weight set 116 may include multiple weights 114 that can be selectively connected or disconnected to the carriage 104 of the support structure 102. Each of the weights 114 may comprise substantially the same mass. In other examples, the weights 114 can include different masses.

In the illustrated example, the first and second sections 108, 110 of the carriage 104 include a hanger 118 to which the weights 114 may attach. The weights 114 may include a slot 120 sized to accommodate the height and width 122 of the hanger 118. In such an example, the weights 114 may have an overall U-shape. Both the first and second sections 108, 110 of the carriage 104 may include an inner barrier 124 that separates the weights 114 from the handle 106 and an outer barrier 126 located on a distal end 128 of the first dumbbell 100.

Figure 2:
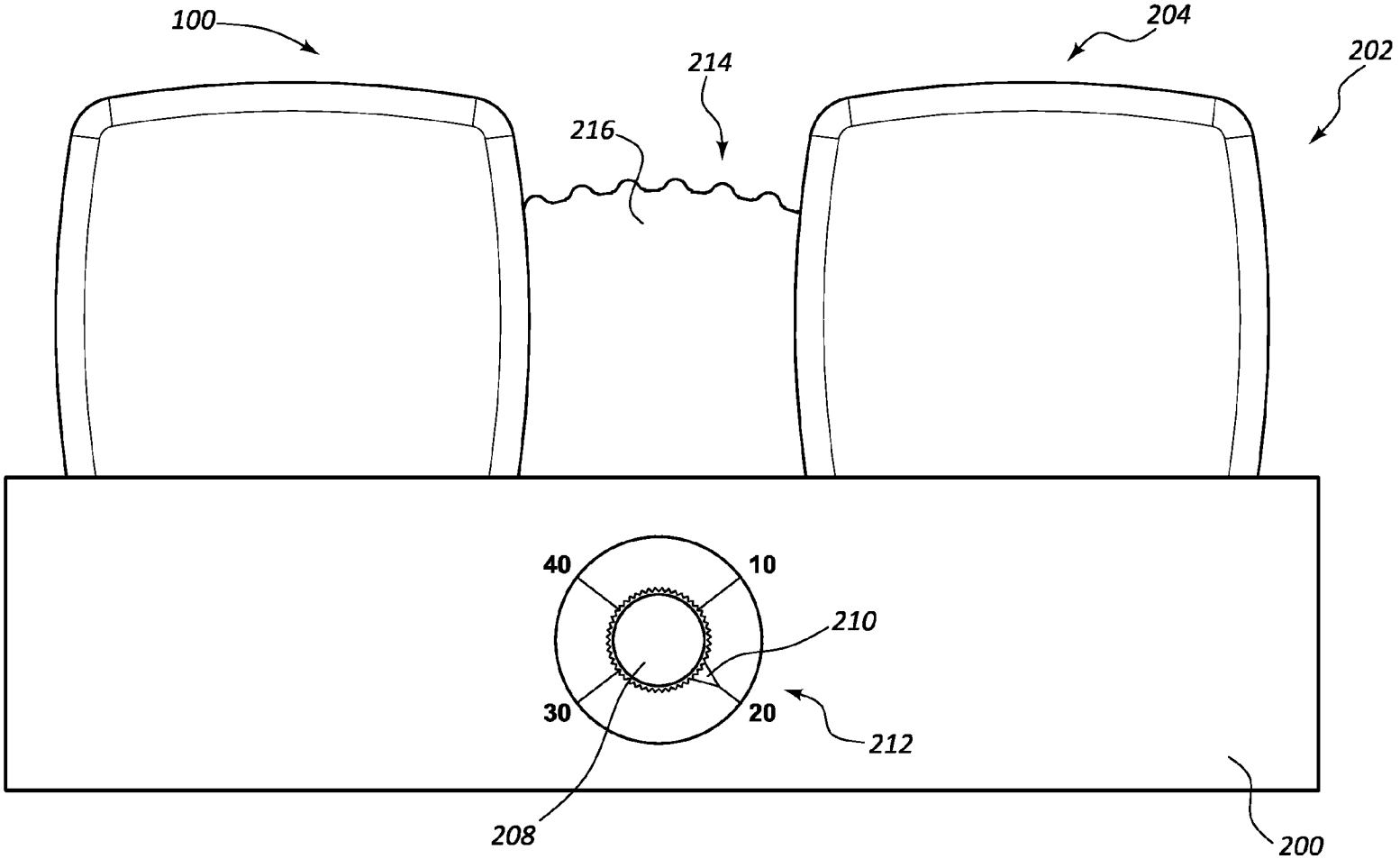
FIG. 2 illustrates a side view of the dumbbell of FIG. 1 positioned within an example of a cradle in accordance with the present disclosure.
Figure 3:
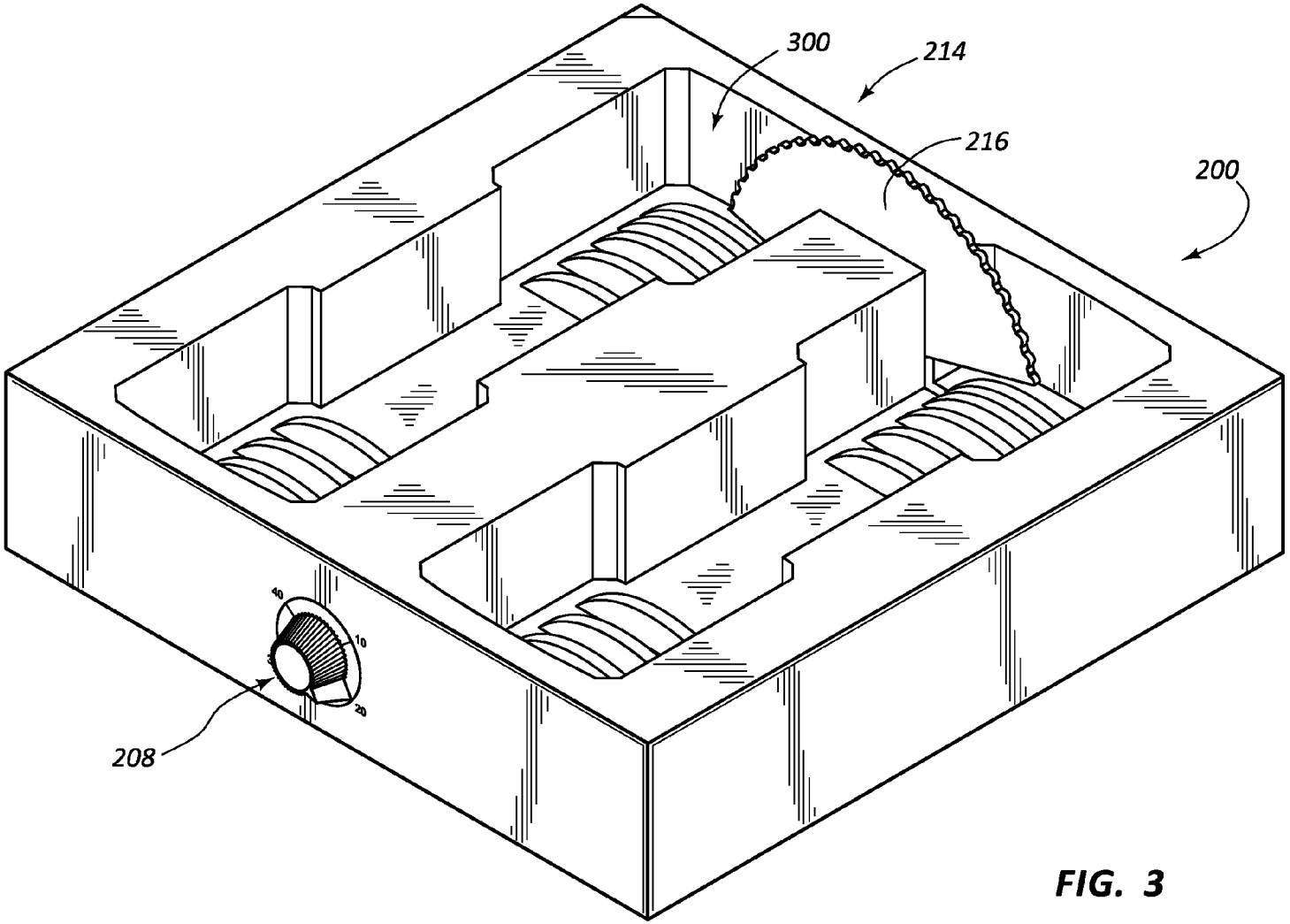
FIG. 3 illustrates a top perspective view of the cradle of FIG. 2.

FIGS. 2 and 3 depict a cradle 200 shaped and sized to receive at least one dumbbell. FIG. 2 depicts such a cradle 200 as part of a dumbbell assembly 202 where the dumbbell assembly 202 includes a first dumbbell 100 and a second dumbbell 204. FIG. 3 illustrates a top perspective view of such a cradle 200. The second dumbbell 204 may be of the same type and make as the first dumbbell 100. For purposes of this disclosure, the first and second dumbbells include the same structure, shape, function, and construction as each other. Thus, in examples of the present invention that incorporate the first dumbbell depicted in FIG. 1, the second dumbbell 204 also includes a second handle, a second support structure, a second carriage, a second weight set, and other features similarly described to those of the first dumbbell 100 of FIG. 1. However, in other examples, the second dumbbell 204 may differ slightly or significantly in structure, shape, function, and construction with respect to the first dumbbell 100.

The cradle 200 includes multiple troughs 300 sized and shaped to receive individual weights 114 from the first and second dumbbells 100, 204. As the first and second dumbbells 100, 204 are docked in the cradle 200, the individual weights align with and are received into the multiple troughs 300 of the cradle 200. The troughs may be sized and shaped to support each individual weight 114 so that in the absence of the support structure and other components of either the first or second dumbbell 100, 204 the individual weights may stand upright. As such, there may be little to no gap between the outer surface of the weights 114 and the inner surfaces of the troughs 300 when the weights are disposed upright within the troughs 300.

The cradle 200 may include an input mechanism 208. In the illustrated example, the input mechanism 208 is a rotary dial that includes a feature 210 that may be positioned proximate numerical values 212 on the outer surface of the cradle 200. Such numerical values 212 may represent possible weight amounts that reflect the weight of the dumbbell's structure with various combinations of the weights 114 of the first or second weight sets. For example, the first dumbbell's structure may be five pounds without any of the weights attached. In such an example, one of the weights 114 may be a five pound plate, and when the five pound plate is attached to the first dumbbell's structure, the total weight of the first dumbbell 100 is ten pounds. Additional weights may be ten pound weights. In such an example, the combination of the five pound plate, ten pound plate, and the dumbbell's structure make the overall weight of the first dumbbell twenty pounds. The dumbbell 100 may include any appropriate number of weights with any appropriate mass. The user may use the input mechanism to connect and/or disconnect any combination of weights 114 from the dumbbell's support structure 102. Thus, in examples with a rotary dial input mechanism, a user may adjust the rotary position of the rotary dial to indicate the desirable amount of weight for the first and second dumbbell 100, 204. Such a rotary dial may operate to select the appropriate amount of weight for each of the first and second dumbbells 100, 204 at the same time. For example, the user may indicate through the input mechanism that the desirable weight is thirty pounds. In such an example, the selection mechanisms of the dumbbell assembly may cause the appropriate changes to the connections of the first and second weight sets to cause each of the first and second dumbbells 100, 204 to have an overall weight of thirty pounds.

The rotary dial may be in communication with a selection mechanism 214 that is incorporated into the cradle 200. In the illustrated example, the selection mechanism 214 includes a rotary gear 216 that may mesh with selectors that are incorporated into the first and second dumbbells 100, 204. In some examples, the rotary gear 216 may rotate with the rotary dial. The rotation of the rotary gear 216 may cause the selectors to move. Such movement of the selectors may cause adjustments to the connection between the weights 114 and the carriage 104 of the first and second dumbbells 100, 204. For example, as the selectors move, a subset of the weights may disconnect from or connect to the carriage 104. The position of the feature 210 of the rotary dial may correspond with the amount of weight attached to the first and second dumbbells 100, 204. For example, when the feature 210 is positioned adjacent to the numerical value "20," a subset of weights may attach to the carriage such that the overall weight of the first dumbbell 100 is twenty pounds and the overall weight of the second dumbbell 204 is twenty pounds.

Such an input mechanism 208 of the dumbbell assembly 202 allows the user to provide a single input that causes the weight connections of both the first and second dumbbell to change. In some cases, such changes occur simultaneously. In other cases, the changes may occur at different moments in time but still in response to the input from the single input mechanism. While the illustrated example depicts the input mechanism 208 as a rotary dial, any appropriate input mechanism may be used in accordance with the principles described in the present disclosure. For example, the input mechanism 208 may include a touch screen, key pad, button, lever, switch, slider, microphone, sensor, another input of input mechanism, or combinations thereof.

While the cradle 200 is depicted as being shaped to receive just the first and second dumbbells 100, 204, the cradle 200 may be shaped to receive any appropriate number of dumbbells. For example, the cradle 200 may be shaped to receive three or four dumbbells at a time. In such examples, the input mechanism may be used to adjust the connections between the weights 114 and the carriages 104 for each of the dumbbells. In some examples, such as examples that incorporate a touch screen or other type of input mechanism, a single input mechanism may be used to selectively adjust the connections between the weights 114 and the carriage 104 for just a subset of the dumbbells while the remainder of the dumbbells are unaffected. In other examples, the connections for each of the dumbbells are adjusted at the same time.

Figure 4:
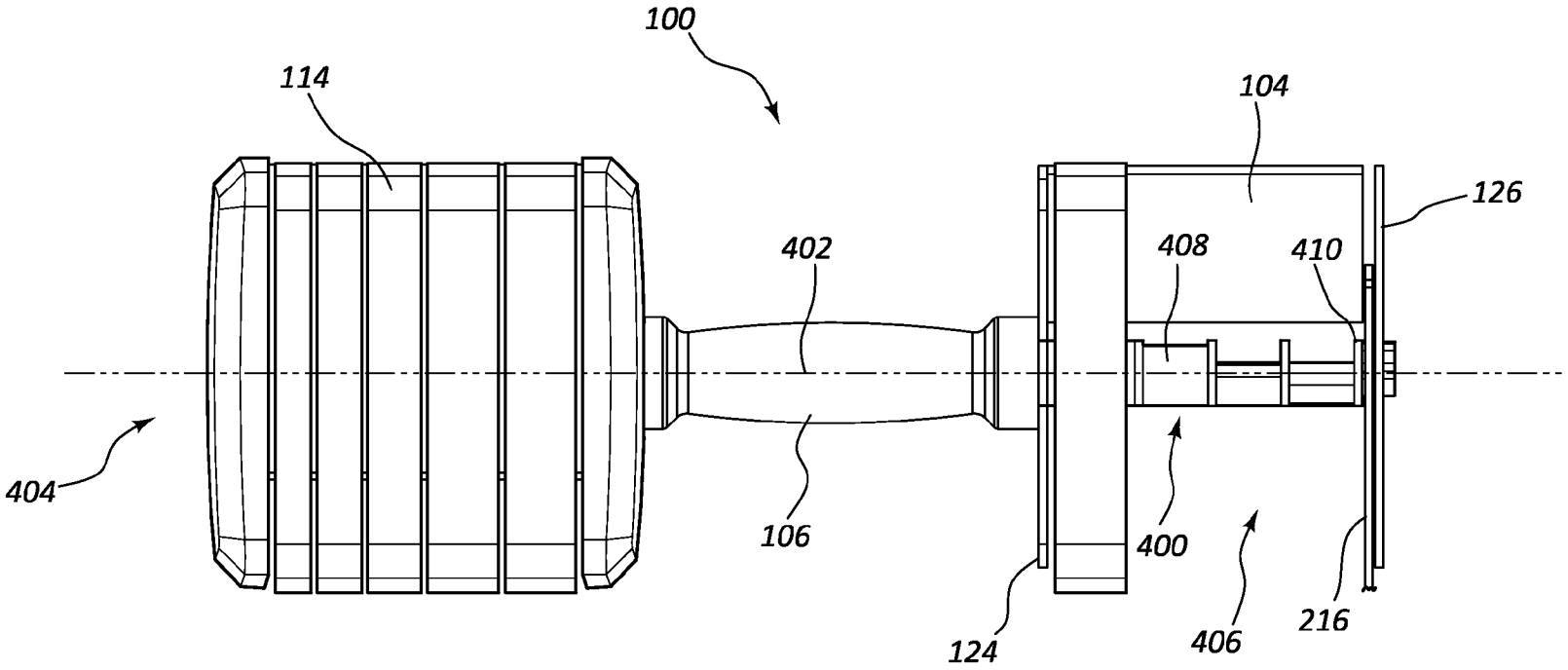
FIG. 4 illustrates a side view of the dumbbell of FIG. 1 with selected weights removed.
Figure 5:
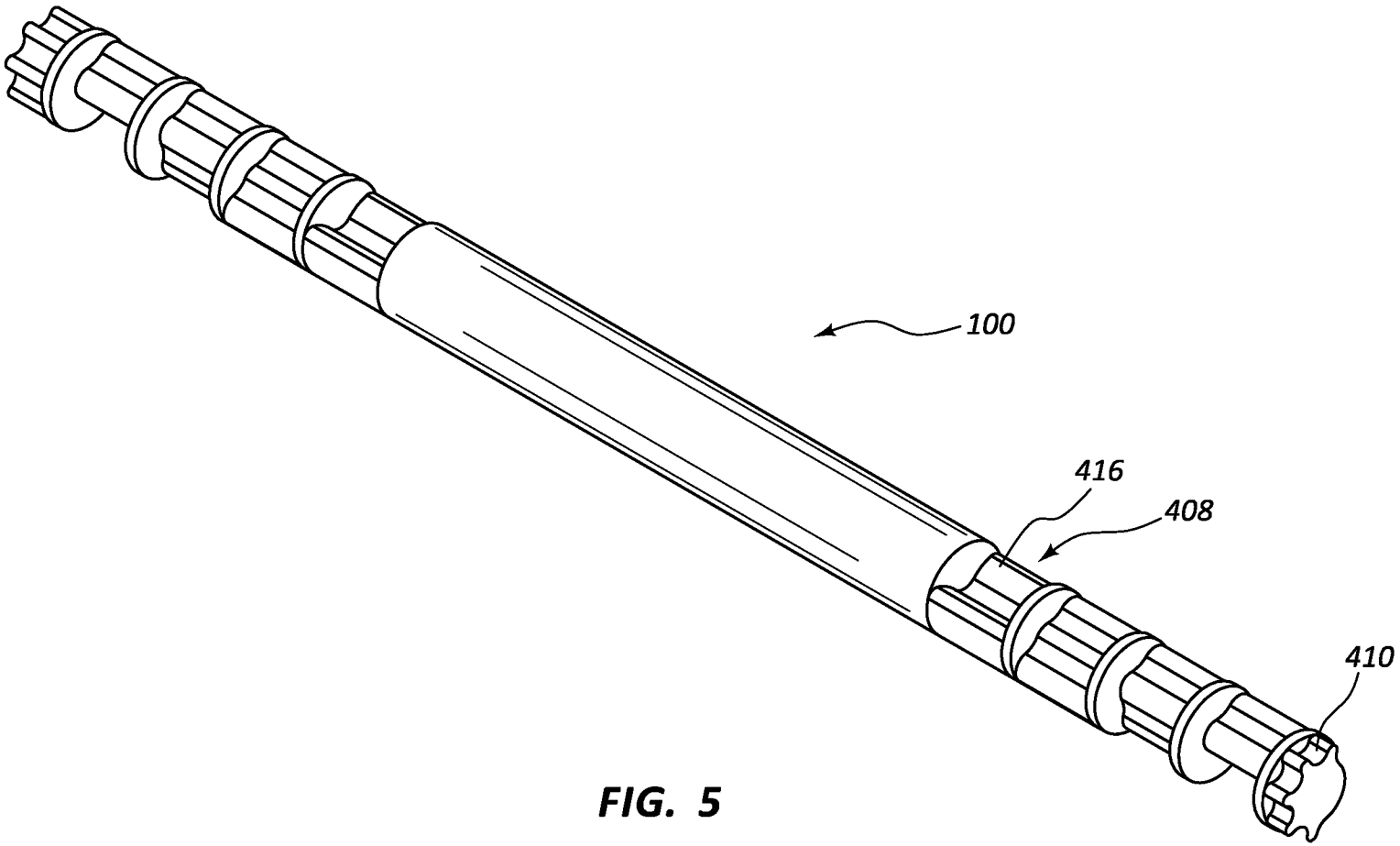
FIG. 5 illustrates a perspective view of an example of a selector in accordance with the present disclosure.
Figure 6:
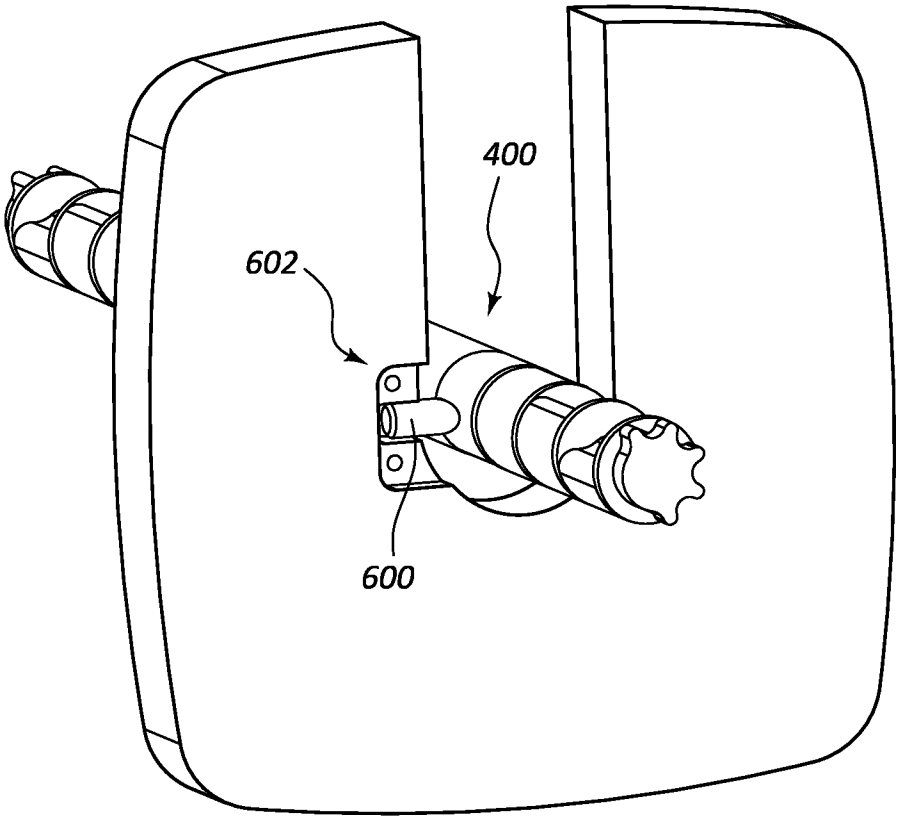
FIG. 6 illustrates a perspective view of the selector of FIG. 5 together with an example of a weight in accordance with the present disclosure.

FIGS. 4-6 depict a selector 400 incorporated into a dumbbell 100. In the illustrated examples, the selector 400 includes a longitudinal axis 402 that spans from the first section 108 of the carriage 104 to the second section 110 of the carriage 104. The longitudinal axis 402 may align with a central axis of the handle 106. In some examples, the longitudinal axis 402 is coaxial with a central axis of the handle 106. A mid-section 222 of the selector is shaped to reside within a cavity formed in the handle 106. A first end 404 of the selector 400 resides in the hanger 118 of the first section 108 of the carriage 104, and a second end 406 of the selector 400 resides in the hanger 118 of the second section 110 of the carriage 104.

The selector 400 may comprise a plurality of cams 408 and a gear sprocket 410. In this example, each of the cams 408 corresponds with one of the weights. The cams 408 may control the position of an interlocking pin 600 that is associated with each of the weights 114. Such an interlocking pin 600 may be retained within a pocket 602 formed in the weight 114. In other examples, the interlocking pins 600 are retained in a selector assembly. In either arrangement, the interlocking pins move as the cams 408 moves, which occurs when the selector 400 is rotated. The gear sprocket 410 is located at the first end 404 of the selector 400 and is positioned to mesh with the rotary gear 216 of the selection mechanism 214 incorporated into the cradle 200. Thus, as the rotary gear 216 rotates, the selector 400 will also rotate. In examples with a rotary dial, a mechanical linkage from the rotary dial to the interlocking pin 600 is created through the rotary gear 216 and the selector 400. The rotary gear 216 may directly mesh with the gear sprocket 410 of the selector. In other examples, intermediary gears indirectly mesh the rotary gear 216 with the gear sprocket 410.

The selector 400 of the first dumbbell 100 is positioned on a different side of the rotary gear 216 as the selector of the second dumbbell 204. The rotary gear 216 may mesh with each of the selectors at the same time and cause the selectors to rotate in opposing directions. For example, as the rotary gear 216 rotates in a first direction, the teeth on a first side of the rotary gear 216 will move upwards while the teeth on a second end of the rotary gear 216 will move downward. Thus, the teeth intermeshed with the first and second selectors will cause the first and second selectors to rotate in different directions. In some examples, the first selector is a mirror image of the second selector. In such an example, the first and second selectors are specifically customized so that the first dumbbell 100 and the second dumbbell 204 must be placed in specific troughs of the cradle. In other examples, the selectors 400 are shaped such that the first and second dumbbells 100, 204 can be placed in any trough of the cradle 200.

In some examples, the position of each cam 408 may determine whether the corresponding weight 114 is connected or disconnected to the hanger 118. The position of the cams 408 may determine the position of the interlocking pin 600 or another feature that can connect or disconnect with the hanger 118 or other part of the support structure 102.

In one example, the interlocking pins 600 are retained by a selector assembly that is incorporated in the dumbbell 100. In such an example, the interlocking pin 600 may be spring loaded or otherwise urged into the selector assembly. As the selector 400 rotates, the cam's lobe 416 moves into a position that forces the interlocking pin 600 against a spring load or other type of force into a pocket 602 formed in the weight. In such an example, when the interlocking pin 600 protrudes into the weight's pocket 602, the interlocking pin 600 connects the weight 114 to the support structure 102 of the dumbbell 100. Thus, as the dumbbell 100 is lifted from off of the cradle 200, the weight 114 is affixed to the support structure 102 and travels with the dumbbell 100.

In another example, the interlocking pin 600 is retained within the pocket 602 of the weight 114. A spring force or another type of force urges the interlocking pin 600 towards the selector 400. As the cam's lobe 416 rotates, the selector 400 pushes the interlocking pin 600 back into the weight's pocket 602. In this example, when the interlocking pin 600 is allowed to protrude into the selector 400, the interlocking pin 600 connects the weight 114 to the support structure 102 of the dumbbell 100. Thus, as the dumbbell 100 is lifted from off of the cradle 200, the weight 114 is affixed to the support structure 102 and travels with the dumbbell 100. However, when the cam's lobe 416 pushes the interlocking pin 600 back into the weight's pocket 602, the weight 114 is released from the dumbbell's support structure 102 such that when the dumbbell 100 is removed from the cradle 200, the weight 114 remains in the cradle's trough.

In some examples, each of the interlocking pins 600 is located on a single side of the selector 400. However, in other examples, at least one of the interlocking pins 600 and corresponding pocket 602 formed in the weight 114 is located on a different side of the selector 400, such as an opposite side, an underside, another type of side, or combinations thereof.

While the examples above have been described with reference to interlocking pins 600 for connecting and disconnecting the weights 114 to the support structure 102, any appropriate type of connection mechanism may be used. For example, a non-exhaustive list of connection mechanisms may include a spring loaded disk, a magnetic connection, a threaded member, a compression fit, a hook, a latch, another type of connection mechanism, or combination thereof.

In examples with an interlocking pin 600, the interlocking pin 600 may be made of a material with a sufficient strength to carry the load of the weight 114 with the support structure 102. Such a material may include a metal or harden plastic. Further, the interlocking pins, cams, sprocket, and other components involved with movement associated with connecting and disconnecting the weights 114 may include hardened surfaces to reduce friction and/or reduce wear.

The selector 400 may be arranged to connect and disconnect the weights 114 in any appropriate order. For example, as the selected amount of weight increases, the cams may move to connect the weights 114 to the support structure 102 in a sequential order. In other examples, the weights may be connected in an alternating order. Yet in other examples, the weights may be connected in another order.

Figure 7:
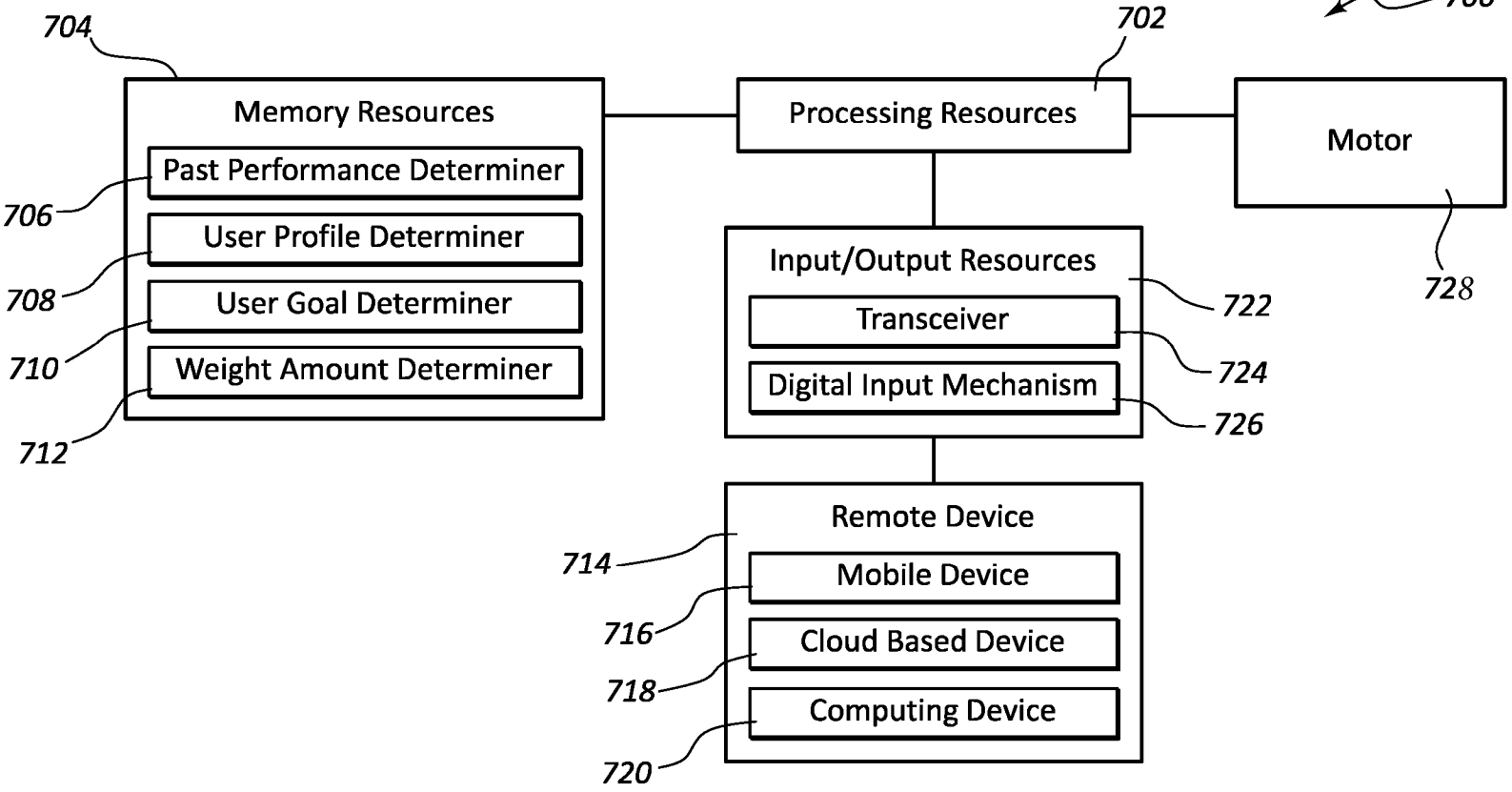
FIG. 7 illustrates a block diagram of a selection system in accordance with the present disclosure.

FIG. 7 illustrates a block diagram of an example of a system 700 for adjusting weight of an adjustable dumbbell. The system 700 may include a combination of hardware and programmed instructions for executing the functions of the system 700. In this example, the system 700 includes processing resources 702 that are in communication with memory resources 704. Processing resources 702 include at least one processor and other resources used to process the programmed instructions. The memory resources 704 represent generally any memory capable of storing data such as programmed instructions or data structures used by the system 700. The programmed instructions shown stored in the memory resources 704 include a past performance determiner 706, a user profile determiner 708, a user goal determiner 710, and a weight amount determiner 712.

Further, the processing resources 702 may be in communication with user information and/or workout environment information that may be stored in the memory resources 704 locally or off site. For example, the processing resources 702 may be in communication with a remote device 714 that stores the user information or workout environment information. Such a remote device may be a mobile device 716, a cloud based device 718, a computing device 720, another type of device, or combinations thereof. In some examples, the system communicates with the remote device through the mobile device 716 which relays communications between the system 700 and the remote device. In other examples, the mobile device 716 has access to information about the user and/or workout environment. In some cases, the remote device collects information about the user during his or her workout or in general. In one such example, a treadmill used by the user may send information to the remote device indicating how long the user ran, the number of calories burned by the user, the average heart rate of the user during the workout, other types of information about the workout, or combinations thereof. This information may be used by programmed instructions for executing its functions. The remote device may execute a program that can provide useful information to the system 700. An example of a program that may be compatible with the principles described herein includes the iFit program which is available through www.ifit.com and administered through ICON Health and Fitness, Inc. located in Logan, Utah, U.S.A. An example of a program that may be compatible with the principles described in this disclosure are described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof. Further, the workout environment information that may be accessible to the remote device may include humidity data, temperature data, elevation data, atmospheric pressure data, sunlight exposure data, other types of environmental data, or combinations thereof.

The processing resources 702, memory resources 704, and remote devices may communicate over any appropriate network and/or protocol through the input/output resources 722. In some examples, the input/output resources 722 includes a transceiver 724 for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the system 700 through a digital input mechanism 726, a mechanical input mechanism, another type of mechanism, or combinations thereof.

The memory resources 704 include a computer readable storage medium that contains computer readable program code to cause tasks to be executed by the processing resources 702. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The past performance determiner 706 represents programmed instructions that, when executed, cause the processing resources 702 to determine the past performance of the user's workout. The past performance may indicate to the system 700 the amount of weight that the user has lifted in previous workouts, which can be used for making a decision about the amount of weight that the user ought to lift during the present workout. Further, the past performance determiner 706 may also determine the amount of exercise/calories that the user has recently performed/burned. Such information can also aid in a decision for the amount of weight for the user to lift. As described above, the system 700 may receive information about other types of workouts that the user recently performed, such as treadmill workouts. However, information about other types of workouts may also be available to the system 700. In such a situation where the past performance determiner 706 determines that the user performed a significant workout recently, such as an hour long run on a treadmill that ended less than ten minutes ago, the system 700 may determine that the user cannot lift weights at a level when the user is fresh because of the amount of calories that the user recently burned. In another example, the past performance determiner 706 may determine that the user recently performed a number of weighted underhand pull ups. In such a situation, the past performance determiner 706 may also determine that the user may not be able to lift as much as the user usually is capable of because of the recent exercises performed.

The user profile determiner 708 represents programmed instructions that, when executed, cause the processing resources 702 to determine information about the user based on information stored in the remote device, the cradle, a mobile device, another device in the system 700, or combinations thereof. Such information, like age, weight, height, and so forth, may be used to determine, at least in part, the amount of weight for the user to lift.

The user goal determiner 710 represents programmed instructions that, when executed, cause the processing resources 702 to determine the user's goals. For example, if the user's goal is to build muscle mass, the system 700 may determine to increase the amount of weight for the user and indicate that a shorter number of repetitions should be executed during the lift. On the other hand, if the user's goal is to build strength while keeping a lean physique, the system may determine to have the user lift a lighter weight amount with a greater number of repetitions during the lift.

The weight amount determiner 712 represents programmed instructions that, when executed, cause the processing resources 702 to determine an amount of weight for the user to lift based on the past performance information, user profile information, user goal information, other types of information, or combinations thereof. In response to determining the amount of weight for the user to lift, the weight amount determiner 712 may send instructions to a motor 728 to rotate the rotary gear 216 to rotate the selector 400 to position the cams in the appropriate location to cause weights 114 to connect and/or disconnect from the support structure 102 so that the overall weight of the first and second dumbbells 100, 204 is the desired weight.

While the weight amount determiner 712 has been described with reference to making decisions based on past performance information, user profile information, and user goal information, the weight amount determiner 712 may use any appropriate type of information to make a decision about the amount of weight for the user to lift. For example, the weight amount determiner 712 may base the decision, at least in part, on nutritional information (such as the type and amount of food ingested by the user over the course of a recent time period), health information, workout environment information, user input, other types of information, or combinations thereof.

In some examples, the weight amount determiner 712 determines the type of workout that the user desires to do. In such a situation, the weight amount determiner 712 may receive the workout type directly from the user. For example, the user may indicate to the system 700 that the user desires to perform curl exercise to work his or her biceps. The weight amount determiner 712 may select a weight amount based on the input about the curl exercise. In accordance, the selection mechanism may cause the appropriate amount of weight to be connected to the support structures 102 and the user may remove the first and second dumbbells 100, 204 from the cradle 200 to perform the indicated exercises. After the user performs the indicated exercise, the user may return the dumbbells to the cradle 200. Next, the user may indicate to the system 700 that the user desires to perform another type of exercise, such as the military press exercise, with the first and second dumbbells 100, 204. In such an example, the weight amount determiner 712 may account for the newly performed curl exercises along with other types of information to determine the weight to select for the military press exercise. The system 700 may accordingly cause the selected amount of weight to be connected to the support structure 102 for the military press exercises.

The user may indicate to the system 700 the workout type through any appropriate mechanism. In some examples, the user may speak into a microphone associated with the system 700 to indicate the workout type. In other examples, the user may use a button, a touch screen, a lever, or another input mechanism incorporated into the cradle, the first or second dumbbell 100, 204, a mobile device, a remote device, another type of device, or combinations thereof.

In other examples, the user is participating in a predetermined program that selects the type of exercises for the user to perform. For example, the user may select a program that is intended to work out a selected muscle group or to enhance performance in a particular type of sport. In such a situation, the user may not have to indicate the workout type to the system 700.

Further, the memory resources 704 may be part of an installation package. In response to installing the installation package, the programmed instructions of the memory resources 704 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources 704 can include integrated memory such as a hard drive, a solid state hard drive, or the like.

In some examples, the processing resources 702 and the memory resources 704 are located within the cradle 200, the first or second dumbbell 100, 204, the mobile device 716, an exercise machine, a remote device, another type of device, or combinations thereof. The memory resources 704 may be part of any of these device's main memory, caches, registers, non-volatile memory, or elsewhere in their memory hierarchy. Alternatively, the memory resources 704 may be in communication with the processing resources 702 over a network. Further, data structures, such as libraries or databases containing user and/or workout information, may be accessed from a remote location over a network connection while the programmed instructions are located locally. Thus, the system 700 may be implemented with the cradle 200, the first or second dumbbell 10, 204, an exercise machine, a user device, a mobile device 716, a phone, an electronic tablet, a wearable computing device, a head mounted device, a server, a collection of servers, a networked device, a watch, or combinations thereof. Such an implementation may occur through input mechanisms, such as push buttons, touch screen buttons, voice commands, dials, levers, other types of input mechanisms, or combinations thereof. Any appropriate type of wearable device may include, but are not limited to glasses, arm bands, leg bands, torso bands, head bands, chest straps, wrist watches, belts, earrings, nose rings, other types of rings, necklaces, garment integrated devices, other types of devices, or combinations thereof.

The system 700 of FIG. 7 may be part of a general purpose computer. However, in alternative examples, the system 700 is part of an application specific integrated circuit.

Figure 8:
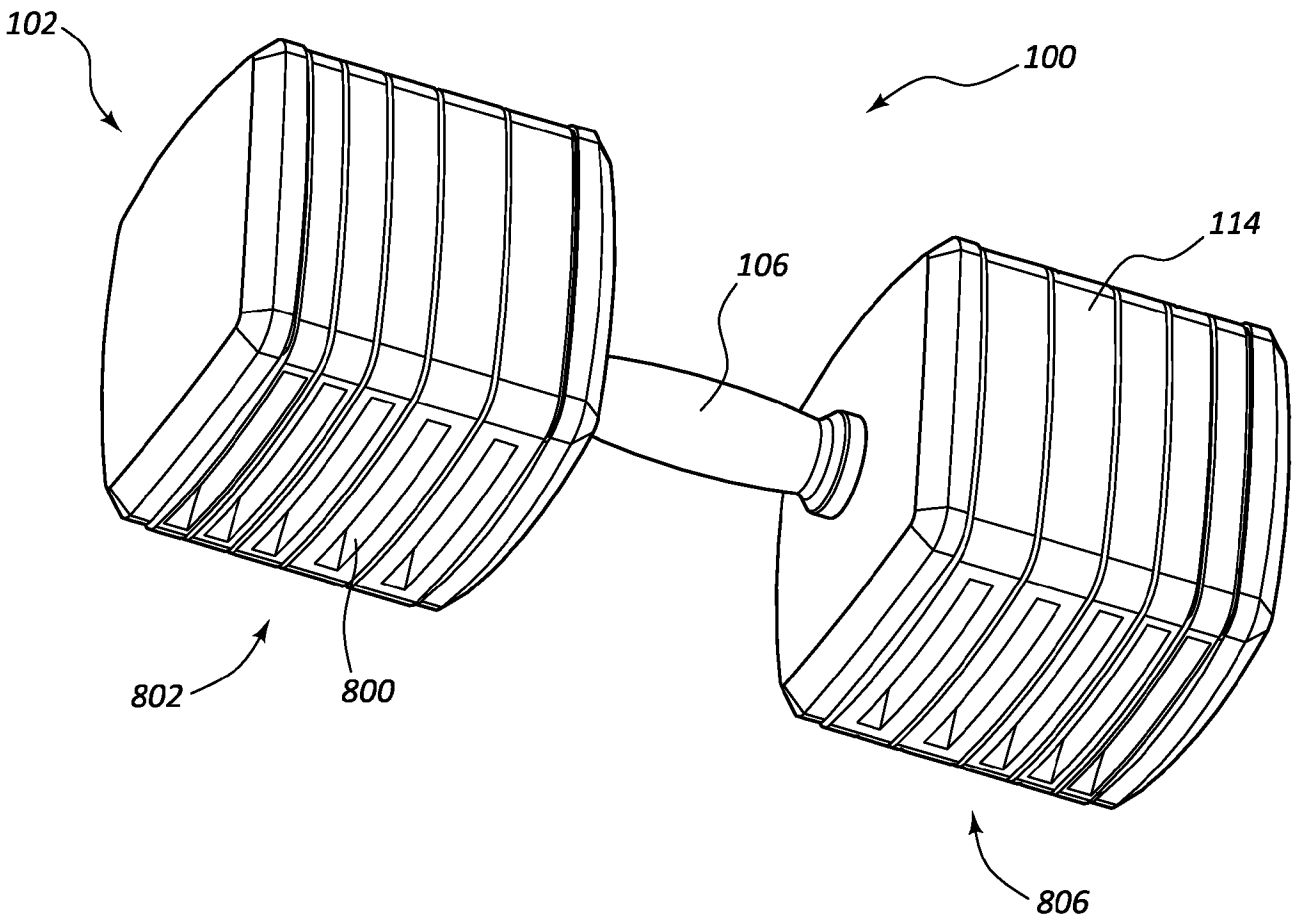
FIG. 8 illustrates a bottom perspective view of an example of a dumbbell in accordance with the present disclosure.
Figure 9:
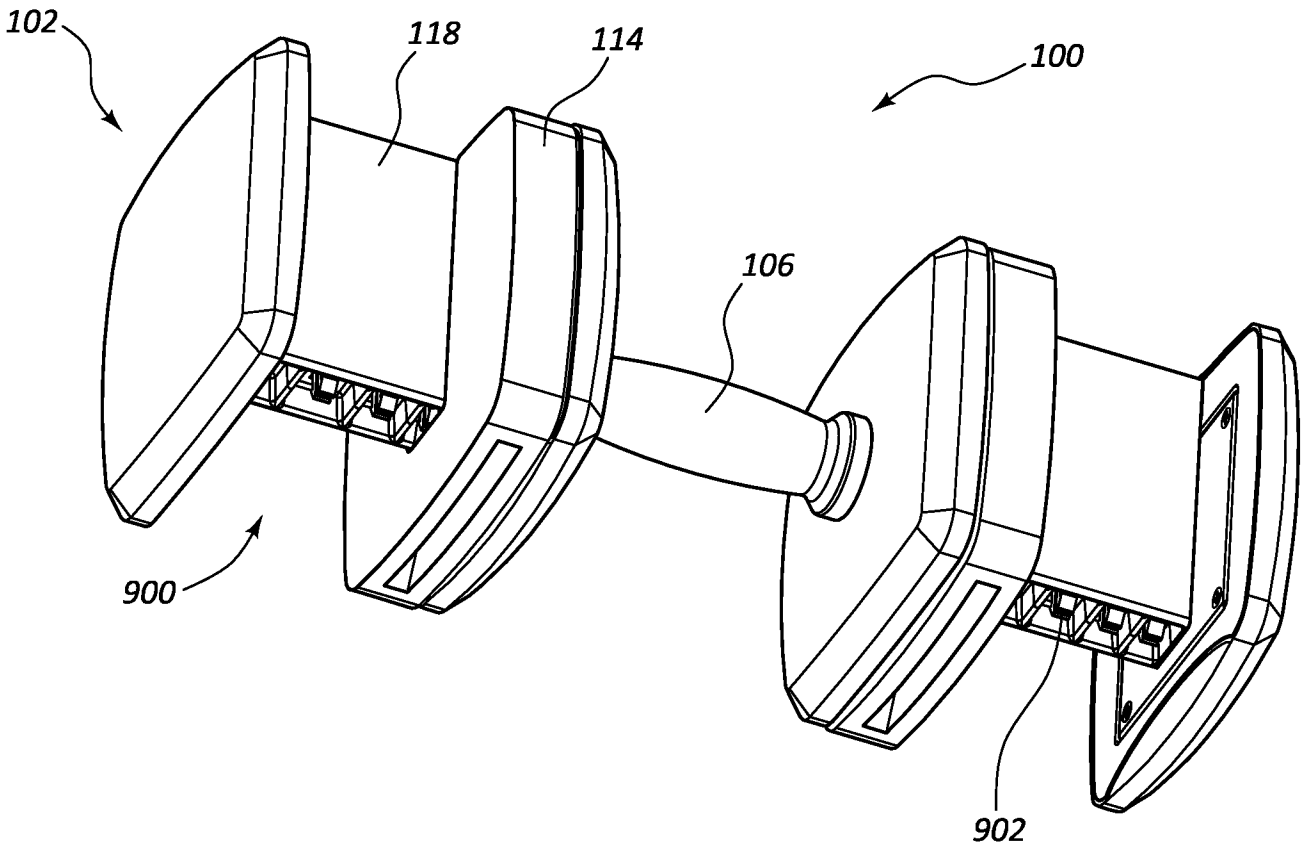
FIG. 9 illustrates a bottom perspective view of the dumbbell of FIG. 8 with selected weights removed.
Figure 10:
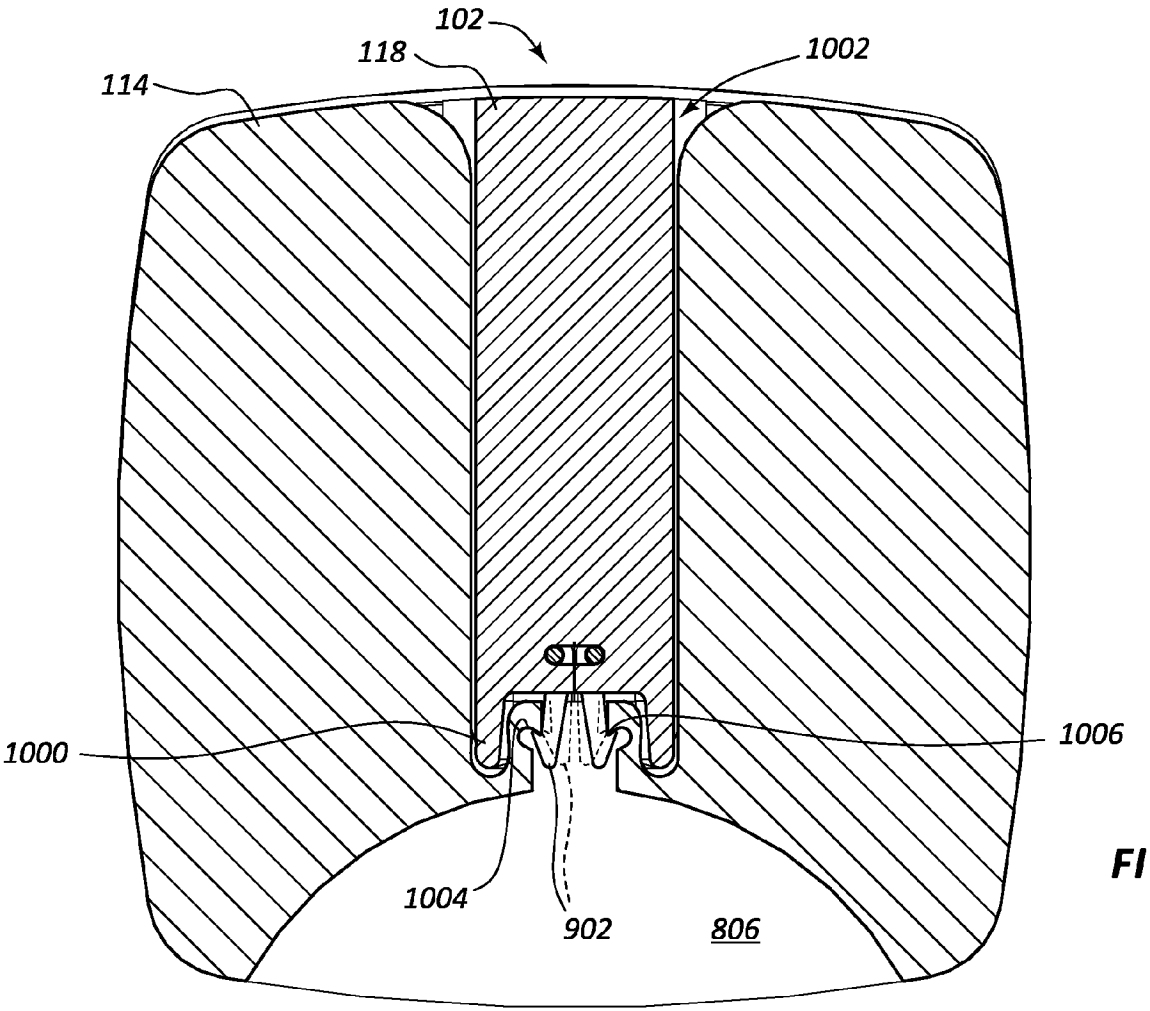
FIG. 10 illustrates a cross sectional view of the dumbbell and weights of FIG. 8.

FIGS. 8-10 are perspective views of another example of a dumbbell 100. In FIG. 8, each of the weights 114 are attached to the dumbbell's support structure 102. In FIG. 9, some of the weights 114 are removed for illustrated purposes. FIG. 10 depicts a cross sectional view of the weighs 114 attached to the hanger 118 of the support structure 102. In this example, the weights 114 connect to the underside 900 of the hanger 118 of the support structure 102. A cradle opening 800 is formed in a cradle side 802 of the weights 114 that provide access to connection features 902 of the hanger 118.

The cradle opening 800 opens into a cavity 806 formed in the weight 114. The cavity 806 also includes a structure opening 1002 positioned proximate to where the dumbbell's support structure 102 fits into the weight 114. The cavity 806 narrows to form a neck 810 proximate the structure opening 1002, and the neck 810 includes a catch 1004 positioned to interlock with the connection features 902.

Figure 13:
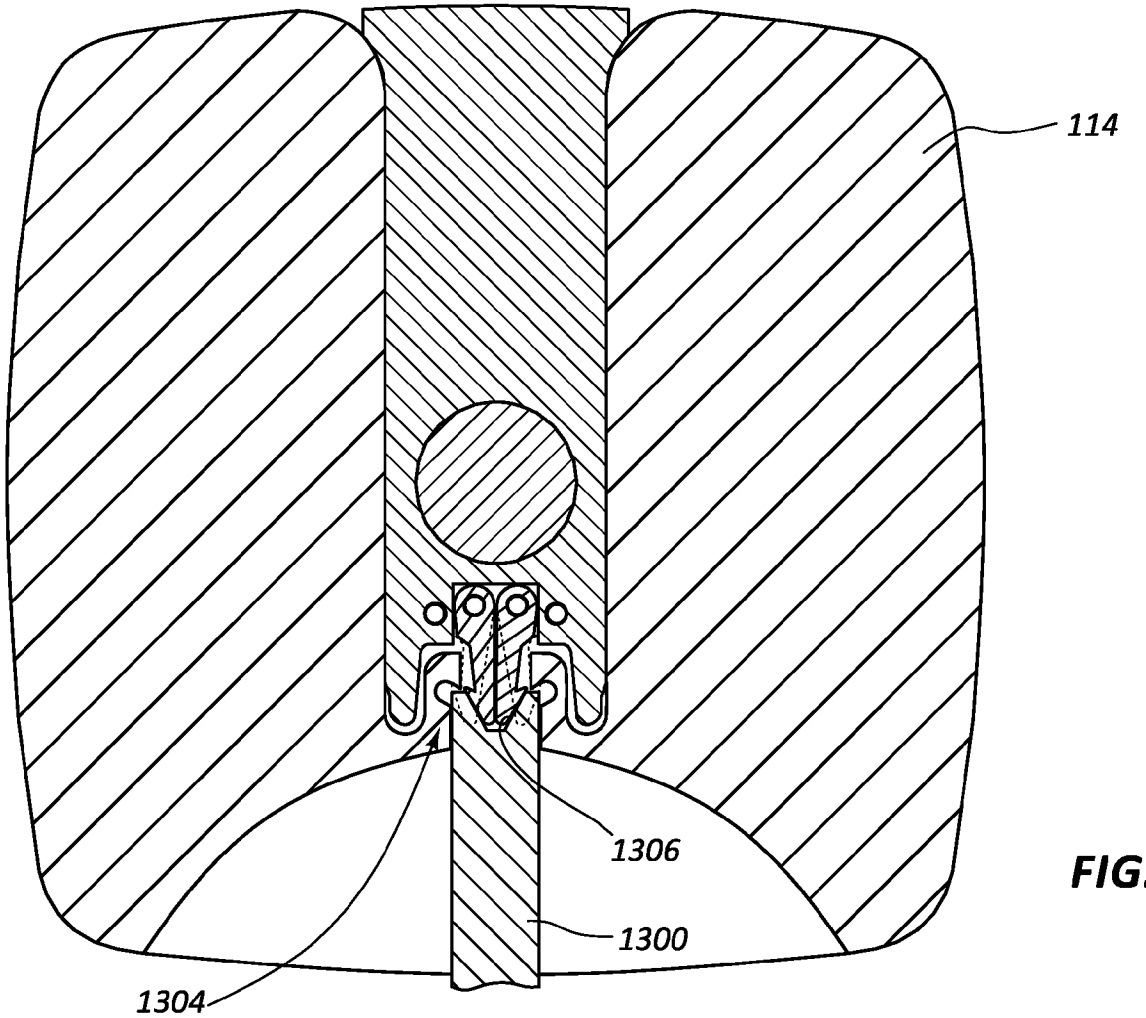
FIG. 13 illustrates a cross sectional view of the dumbbell and weights of FIG. 8 connected to an example of a cradle in accordance with the present disclosure.

The connection features 902 may be any appropriate type of feature that connects or disconnects the weights 114 with the support structure 102. In this example, the connection features 902 include hooks 1006 that are positioned to interlock with the catch 1004 formed in the weight 114 when the hook 1006 is in an interlocking position as shown in FIG. 10. When the connection features 902 are interlocked with the catch 1004, the weights 114 move with the support structure 102. Thus, in this scenario, if a user picks up the dumbbell 100 with the dumbbell's handle 106, the weight 114 is lifted out of the cradle 200 with the dumbbell 100. When the hooks 1006 are in a release position (as depicted in FIG. 13), the hooks 1006 are away from the catch 1004 such that the weight 114 is disconnected from the support structure 102. When the connection features 902 are disconnected from the catch 1004, the weights 114 do not move with the support structure 102. Thus, in this scenario, if a user picks up the dumbbell 100 with the dumbbell's handle 106, the disconnected weight remains stationary in the cradle 200 while the user moves the dumbbell 100.

Figure 11:
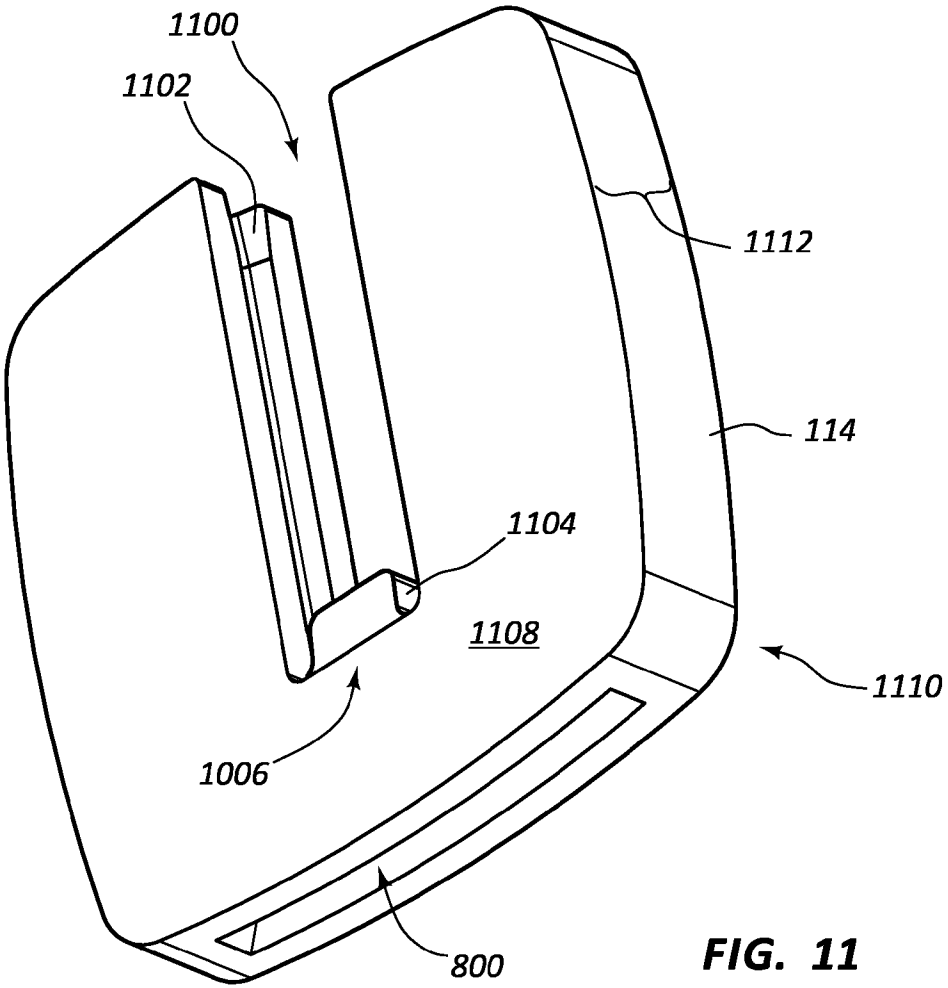
FIG. 11 illustrates a perspective view of an example of a weight in accordance with the present disclosure.
Figure 12:
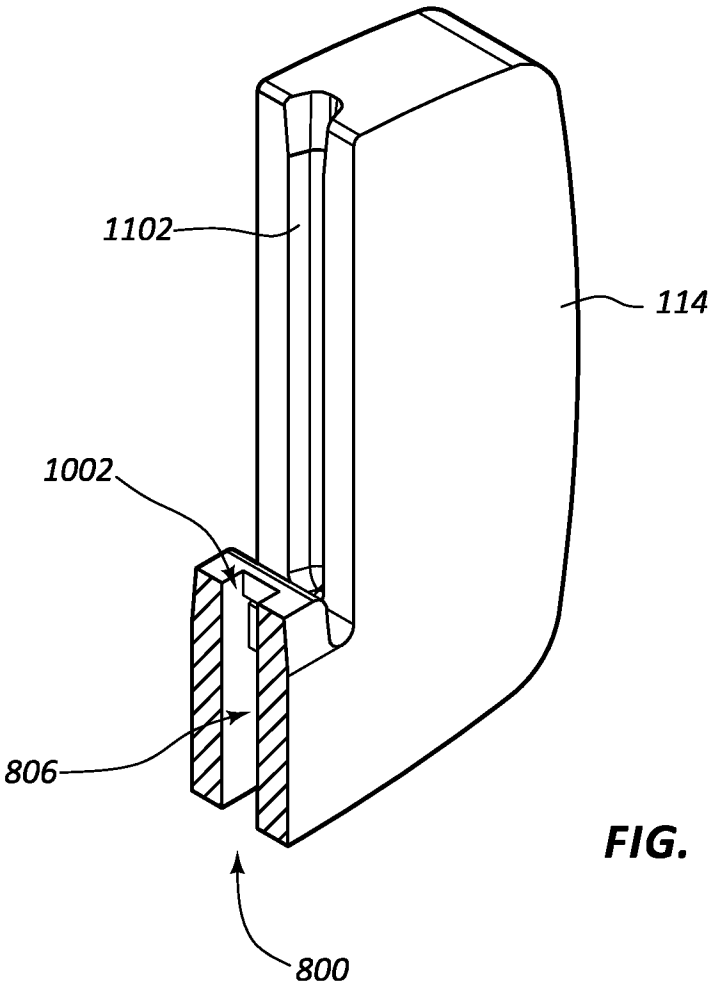
FIG. 12 illustrates a perspective cross sectional view of the weight of FIG. 11.

FIGS. 11-12 depict an example of a weight 114. FIG. 11 illustrates an perspective view of such a weight 114, and FIG. 12 illustrates a perspective cross sectional view of the weight 114 depicted in FIG. 11. In this example, the weight 114 includes a slot 1100 shaped to receive the support structure 102 of the dumbbell 100. As the weights 114 are upright in the cradle 200, the slots 1100 of each of the weights 114 align such that the user can orient the dumbbell 100 so that support structure 102 can slide into multiple weight slots 1100 simultaneously.

A longitudinal groove 1102 may be formed along the length of the slot 1100 which may accommodate a stabilization feature protruding from the support structure 102 as the support structure 102 slides into place. Additionally, a recess 1104 may be formed in the closed end 1106 of the slot 1100. A protrusion 1000 formed on an underside 900 of the support structure 102 may interlock with these recesses 1104 to provide additional stability between a connected weight 114 and the support structure 102.

Also, the cavity 806 has a cradle opening 800 formed in a cradle side 802 of the weight 114. Such an opening allows selectors incorporated into the cradle 200 to have access to the connection features. Also, the cavity 806 includes a structure opening 1002 formed in the closed end 1106 of the slot 1100 that allows the connection features 902 to protrude into the cavity 806. Thus, the cavity 806 provides a space within the weight for components of the dumbbell 100 to directly interact with components of the cradle 200. The interaction between these components determines whether the weight 114 is connected or disconnected with the support structure 102. The cavity 806 forms a through path in the central portion of the weight 114. Further, the cavity is opened to receive components from the cradle 200 and to receive components from the dumbbell 100. The cavity 806 is enclosed by a first face 1108 of the weight 114 and a second face 1110 of the weight 114. Further, the weight 114 is enclosed along a thickness 1112 of the weight 114.

While this example has been described with reference to a specific cavity shape, any appropriate cavity shape may be used in accordance with the principles described in the present disclosure. For example, the cavity may have an opening in a weight face, the catch may be formed in an area of the cavity outside of the neck, the cavity may contain no neck, the cavity may contain additional openings, the cavity may incorporate other features, the cavity may lack some of the features described above, or combinations thereof.

Figure 14:
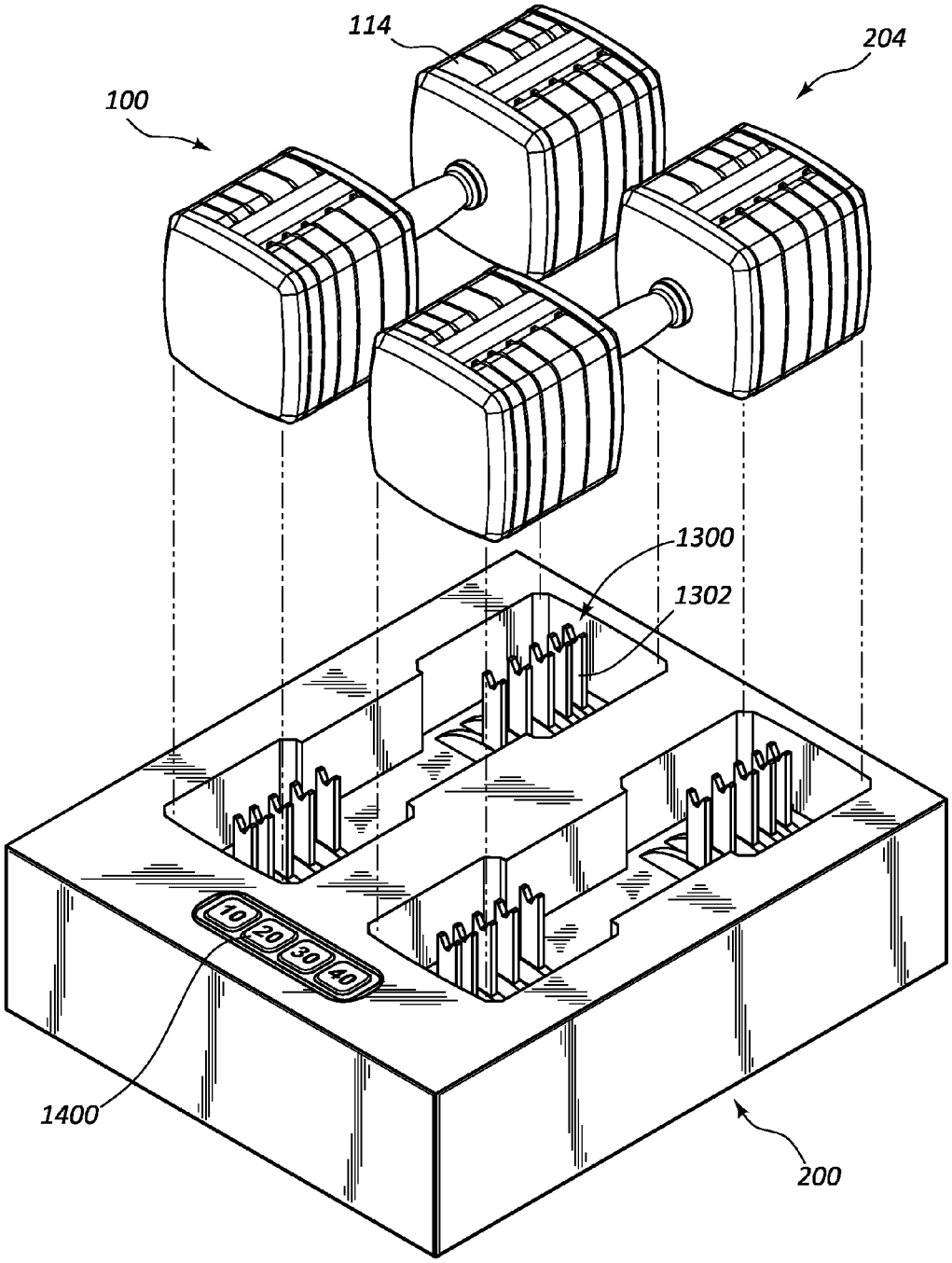
FIG. 14 illustrates a perspective view of the dumbbell and an example of a cradle in accordance with the present disclosure.

FIGS. 13-14 depict an example of an adjuster 1300 incorporated into the cradle 200. In this example, the input mechanism 208 is incorporated into the cradle 200 and includes push buttons 1400 for selecting the appropriate amount of weight for both of the weights simultaneously. While this example has been described with reference to the input mechanism 208 comprising push buttons, any appropriate type of input mechanism 208 may be used, such as a rotary dial, a touch screen, a transmitter, a lever, another type of mechanism, or combinations thereof. Further, the input mechanism may be manually controlled by a user, or the input mechanism 208 activated remotely.

The input mechanism 208 may be mechanically linked to the selectors 400. Such mechanical linkages may include rods, gears, levers, beams, screw mechanisms, cams, other types of mechanism linkages, or combinations thereof. In the illustrated examples, the adjuster 1300 includes a rod 1302 or other protrusion that includes a first linear position and a second linear position. A linear actuator that may be directly or indirectly in communication with the input mechanism 208 and may cause the rod to be in the first linear position or the second linear position. In the first linear position, a distal end 1304 of the adjuster 1300 engages the connection features 902 causing the connection features 902 to disconnect the weight 114 from the support structure 102. The shape of the distal end 1304 includes at least one ramp 1306 positioned to move the hooks 1006 from the interlocking position to the release position.

In the second linear position of the adjuster 1300, the distal end 1304 moves away from the connection features 902. In such a situation, the distal end 1304 may not inhibit the connection features 902 from moving. The connection features 902 may be spring loaded or otherwise urged into the interlocking position when no opposing force is applied to put the connection features 902 into the release position. Thus, as the distal end 1304 moves out of the way, the connection features 902 move back into the interlocking position.

In the illustrated example, when the first and second dumbbells 100, 204 are docked in the cradle 200, the selector can disconnect the corresponding weights 114 by moving the rod 1302 into the first linear position. For those weights 114 that are to remain connected to the first and second dumbbells 100, 204, the rods are position such that the rods do not cause the connection features 902 to release the weights 114. Alternatively, the rods may move to release the weights and reconnect them.

While these examples have been described with reference to a particular type of connection feature, any appropriate type of connection feature may be used in accordance with the principles described in the present disclosure. For example, the connection features may be incorporated into the weights, incorporated into the dumbbells, incorporated into the cradle, or combinations thereof. In other examples, the features may include hooks, interlocking pins, compression mechanisms, balls, springs, pivots, grips, other types of features, or combinations thereof.

Also, while the examples above have been described with reference to specific types of selectors, any appropriate type of selector may be used in accordance with the principles described in the present disclosure. For example, the selectors may include cams, rods, linear actuators, pivots, screw mechanisms, other mechanism, or combinations thereof. Additionally, while the examples above have been described with reference to weights with specific shapes and features, any appropriate type of weight shape or feature may be used in accordance with the principles described in the present disclosure.

INDUSTRIAL APPLICABILITY

In general, the invention disclosed herein may provide a user with a dumbbell assembly that can simultaneously adjust the weights for multiple dumbbells docked in the cradle through a single input mechanism. Such an input mechanism may be a rotary dial, a lever, a group of buttons, a touch screen, a transmitter, another type of mechanism, or combinations thereof. The input mechanism may be in direct or indirect mechanical communication with a selector that is incorporated into the dumbbell, the weights, cradle, or combinations thereof. The selectors are arranged to make adjustments to the connections between the weights sets and the dumbbells. The selectors may be incorporated directly into the cradle, the dumbbells, or the weights.

In some situations, the input mechanism causes a rotary gear to rotate, which causes the selectors to rotate. The new rotational position of the selectors causes a change in the weights that are connected and/or disconnected from the dumbbell. In other examples, the input mechanism sends an electric signal to an actuator or another type of mechanism to cause a selector to move into a different position and thereby cause a change in the weight set connections. In other examples, the input mechanism is in communication with a motor that causes the selector, actuator, or other type of mechanism to move to cause a change in the weight set connections.

Any appropriate type of selector may be used. For example, the selectors may incorporate ramps, rods, springs, cams, magnetic mechanisms, hydraulic mechanisms, pneumatic mechanisms, compression mechanisms, other types of mechanisms, or combinations thereof. In some examples, the selector includes a groove shaped to allow an interlocking pin to retract and thereby release a subset of weights from the dumbbell based on the rotary position of the selector.

The cradle may include multiple troughs for receiving multiple dumbbells. When docked in the troughs, the connection between the weights and the dumbbells can be changed simultaneously in each dumbbell or a subset of dumbbells by using the single input mechanism. The input mechanism may be arranged to receive manual input from a user or receive a remote signal from remote device. Such a remote device may be a mobile device, a device operated by a remote trainer, a cloud based device executing an exercise program, exercise equipment, another type of device, or combinations thereof.

What is claimed is:

1. A dumbbell assembly, comprising:

a cradle shaped to receive a first dumbbell having a first weight set and a second dumbbell having a second weight set;

a first selector integrated into the first dumbbell and arranged to selectively connect or disconnect one or a plurality of weights of the first weight set to the first dumbbell;

a second selector integrated into the second dumbbell and arranged to selectively connect or disconnect one or a plurality of weights of the second weight set to the second dumbbell;

a selection mechanism incorporated in the cradle, wherein the selection mechanism is in communication with both the first selector and the second selector;

an input mechanism in communication with the selection mechanism; and wherein a longitudinal axis of the first selector is coaxial with a central axis of a first handle of the first dumbbell.

2. The dumbbell assembly of claim 1, wherein the input mechanism is incorporated into the cradle.

3. The dumbbell assembly of claim 1, wherein the input mechanism comprises a rotary dial.

4. The dumbbell assembly of claim 3, wherein the selection mechanism comprises a rotary gear positioned to rotate the first selector and the second selector simultaneously as the rotary dial is rotated.

5. The dumbbell assembly of claim 1, further comprising a motor in communication with the input mechanism, wherein the motor selectively actuates the selection mechanism.

6. The dumbbell assembly of claim 1, wherein the first selector is aligned with a first support structure of the first dumbbell and the second selector is aligned with a second support structure of the second dumbbell.

7. The dumbbell assembly of claim 1, wherein the first selector includes a first cam mechanism arranged to selectively connect or disconnect one or a plurality of weights of the first weight set to the first dumbbell and the second selector includes a second cam mechanism arranged to selectively connect or disconnect one or a plurality of weights of the second weight set to the second dumbbell.

8. The dumbbell assembly of claim 1, wherein the first selector comprises a first rod configured to disconnect a first weight of the first weight set from the first dumbbell and the second selector comprises a second rod configured to disconnect a second weight of the second weight set from the second dumbbell.

9. The dumbbell assembly of claim 1, wherein the first selector and the second selector comprise rotary selectors.

10. The dumbbell assembly of claim 1, wherein the first selector is in communication with a first interlocking pin positioned to interlock a first subset of the first weight set with the first dumbbell based on a first rotary orientation of the first selector and the second selector is in communication with a second interlocking pin positioned to interlock a first subset of the second weight set with the second dumbbell based on a first rotary orientation of the second selector.

11. The dumbbell assembly of claim 10, wherein the first selector comprises a groove shaped to allow the first interlocking pin to retract and release the first subset of the first weight set from the first dumbbell based on a second rotary orientation of the first selector.

12. The dumbbell assembly of claim 11, wherein the second selector comprises a groove shaped to allow the second interlocking pin to retract and release the first second subset of the second weight set from the second dumbbell based on a second rotary orientation of the second selector.

* * * * *